US007110846B2

(12) United States Patent
Hellstroem et al.

(10) Patent No.: US 7,110,846 B2
(45) Date of Patent: Sep. 19, 2006

(54) YARN PROCESSING SYSTEM AND YARN FEEDING DEVICE

(75) Inventors: Jerker Hellstroem, Nol (SE); Lars Helge Gottfrid Tholander, Haverdal (SE); Niklas Wahlgren, Goeteborg (SE)

(73) Assignee: Iropa AG, Baar (CH)

( * ) Notice: Subject to any disclaimer, the term of this patent is extended or adjusted under 35 U.S.C. 154(b) by 0 days.

(21) Appl. No.: 10/480,313

(22) PCT Filed: Jun. 27, 2002

(86) PCT No.: PCT/EP02/07135

§ 371 (c)(1),
(2), (4) Date: Jun. 28, 2004

(87) PCT Pub. No.: WO03/002800

PCT Pub. Date: Jan. 9, 2003

(65) Prior Publication Data

US 2004/0238060 A1 Dec. 2, 2004

(30) Foreign Application Priority Data

Jun. 27, 2001 (SE) ..... 0102323

(51) Int. Cl.
*G06F 19/00* (2006.01)

(52) U.S. Cl. ..... 700/130

(58) Field of Classification Search ..... 700/130, 700/136, 138, 140; 139/452
See application file for complete search history.

(56) References Cited

U.S. PATENT DOCUMENTS 5,246,039 A 9/1993 Fredriksson

FOREIGN PATENT DOCUMENTS

WO WO 00/49474 8/2000
WO WO 01/31410 5/2001

*Primary Examiner*—Danny Worrell
(74) *Attorney, Agent, or Firm*—Flynn, Thiel, Boutell & Tanis, P.C.

(57) ABSTRACT

The invention relates to a yarn processing system comprising a textile machine and at least one yarn feeding device, which are assigned to the peripheral auxiliary devices wherein the yarn feeding device has a computerised control device that is connected by signal transmission to the auxiliary device. At least certain auxiliary devices have at least one component configured in such a way that they generate and/or receive signals. The yarn feeding device has at least one local, autonomous communication bus system for the transmission of serial data at least from and/or to the auxiliary devices, said bus system being connected to the control device.

5 Claims, 5 Drawing Sheets

YARN PROCESSING SYSTEM AND YARN FEEDING DEVICE

FIELD OF THE INVENTION

The present invention relates to a yarn processing system for a textile machine, and to a yarn feeding device for association with a textile machine.

BACKGROUND OF THE INVENTION

Yarn processing systems, e.g. including a weaving machine and yarn feeding devices, contain accessory devices along the yarn path from the yarn supply up to, in some cases, the exit side of the weaving shed. The accessory devices serve to control, treat, monitor, scan, convey, etc. the yarn. At least some accessory devices have a signal transmitting connection to the control device of the yarn feeding device in order to transmit return messages or commands or to carry out adjustments of functional parameters. This needs considerable cabling equipment, representing acute error sources, and requires a sophisticated equipment and adaptation of the communicating components. Furthermore, yarn processing systems are known (weaving machine including yarn feeding devices and accessory devices), which are equipped with a rapid communication main bus system for serial data transmission via which e.g. a superimposed control device or the control device of the weaving machine, respectively, communicates with the yarn feeding devices and, in some cases, with the accessory devices. Even information of the speed or the rotational angle of the textile machine and/or of the drive of the yarn feeding device may be transmitted in some cases via the main bus system. Since during operation of the yarn processing system a plurality of data of frequently differing priorities is to be transmitted, and since modern yarn processing systems are extremely complex, the integration also of accessory devices may overwhelm the capability of the main bus system, or the communication with the accessory device may suffer from the dominance of higher ranking communications. The intelligence of the main bus system useable for the accessory devices is limited, e.g. if the main bus system has to interlink a plurality of yarn feeding devices and accessory devices and a jacquard weaving machine. The communication via the main bus system needs a sophisticated and costly equipment of the accessory devices. The volume of data which is to be transmitted may be too large for the main bus system in some cases.

It is the object of the invention to provide a yarn processing system of the kind as disclosed at the beginning as well as a yarn feeding device for such a yarn processing system, with which the above-mentioned drawbacks are avoided and for which unintentionally customised intelligence is useable for the communication with accessory devices.

In the local bus system only accessory devices will communicate at least with the control device of the yarn feeding device which accessory devices are connected to the local bus system. Superimposed or higher ranking communications do not interfere with or limit the accessory device data exchange. The local bus system is adapted with reduced efforts for the functions which are to be carried out by the accessory devices and is designed with an intelligence intentionally coping with the accessory devices and allowing an optimum yarn control, yarn monitoring or yarn treatment, respectively. A serial data transmission within the local bus systems allows to achieve sufficient quickness and reliability. The autonomic design of the local bus system makes the bus system independent from in some cases superimposed communications of the yarn feeding device within a main bus system. In some cases the yarn feeding device may operate independent from the textile machine even only depending on the yarn consumption to which the yarn feeding device with the accessory devices within the local bus system is reacting itself by monitoring and controlling actions.

Expediently, the local bus system is customised for the communication with the accessory devices and may, e.g., for that reason be simpler in terms of the cabling equipment, even if the accessory devices may have a fair cost equipment which would not be directly compatible with a main bus system. This allows to save costs. Furthermore, at any time accessory devices may be added or removed, since the local bus system is very flexible.

The yarn feeding device with its local bus system for the accessory devices is capable to optimally adapt to the operation conditions and to communicate with the accessory devices on a high level of operational safety. The control device of the yarn feeding device is informed about the actions in and at the accessory devices, is apt to precisely control, adjust, activate or de-active the accessory devices. Thanks to a serial data transmission even complex data may be transmitted rapidly and reliably. The local bus system may be designed in a flexible fashion such that an unlimited number of accessory devices of different kinds may be connected to or removed without interference with superimposed data transmission processes in a main bus system which may be provided in some cases. Normally, two conductors suffice for the local bus system, in some cases even a connection having only one conductor. Respective interface processors or simple microcontrollers or PC-boards allow a simple equipment of the accessory devices and within the local bus system.

In a premium communication system each feeding device of the yarn processing system is a node of a rapid communication main bus system via which the yarn feeding devices communicate with each other or with a superimposed control device and/or a control device of the textile machine, via which they receive commands or information or supply return messages. Another kind of data transmission may take place in the main bus system than in the local bus system. It is, however, possible to choose at least similar data transmission kinds in the main bus system and in the local bus system in order to e.g. selectively carry out also an indirect communication from the main bus system to a local bus system, or vice versa. The local bus system of the yarn feeding device provided for the connected accessory devices may be a complementary sub-system for the main bus system.

As the requirements in terms of operation, monitoring or adjustment of accessory devices normally are lower than for the communication between the textile machine and the yarn feeding devices a local bus system may be expedient which is slower in comparison to a rapid main bus system, because then the cabling equipment and the costs for the electronic equipment may be reduced. Such a rapid main bus system e.g. may be a CAN-bus system operating with a bit transmission rate larger than 20 kbps while the slower local bus system only needs to be designed for a bit transmission rate of less than 20 kbps (kilobytes per second). Expediently, the local bus system is a single conductor sub-system being complementary with the rapid main bus system. The sub-system may be based on a UART-standard-equipment of the control of the yarn feeding device (universal asynchronous receiver and transmitter). The reason is that UART-connections are by far the simplest prerequisite for implementing a serial communication. Such UART-connections already are present in the form of on-chip-periphery equipment in virtually all modern microcontrollers. Within the UART-standard messages are transferred in the form of bytes-level-characters. By completion with some external, simple driving circuitries and by interlinking two UART-connections a simple single conductor connection may be achieved (in connection with a logic ground connector). The single conductor connection is connected in wired-or-configuration and allows a bi-directional half duplex-communication. Messages are emitted by the bus master in the form of frames. The specification of the frame defines a simple identifier by which e.g. 60 differently defined messages may be formed. Fair costs low-end microcontrollers may be connected to the single conductor connection on the UART-standard base, i.e., the requirements for the hardware are only low such that totally a fair cost but function safe local bus system can be achieved.

The local bus system based on the UART-standard only needs a single conductor connection of two UART-connections to at least one microcontroller of the accessory device, or via an accessory device-PC board, which in some cases may be completed by an external driving circuit.

In case that such a simple local bus system is used for a relatively slow transmissions of adjustment values, target values, on/off commands, filter adjustments, schemes of modulation, and the like, the local bus system expediently may be completed by at least one separate SYNC-line for the real-time transmission of information representing either the textile machine rotational angle or the textile machine position or the rotational angle or the position of the drive of the yarn feeding device or the respective speeds, respectively. By the common consideration of the communication within the local bus system and of the information given in the separate SYNC-line the accessory devices are apt in a flexible fashion to operate very precisely. Such a local bus system then is upgraded to be substantially of equal value as to a rapid main bus system extending to the accessory devices, which however is by far more costly.

Expediently, accessory devices located at the entrance side of the yarn feeding device, are connected to a SYNC-line which transmits as an information for the operation of the accessory device the speed or the rotational angle or the position of the drive of the yarn feeding device, while accessory devices located at the exit side of the yarn feeding device are connected to a SYNC-line reporting the speed or the rotational angle or the position of the textile machine, respectively. Also in this case the combination of a simple local bus system and of the SYNC-lines results in relatively high intelligence useful for the operation of the accessory devices. A pulse chain which is proportional to the speed, e.g. may be transmitted on the SYNC-line. The accessory device may then combine that information with the content of the communication within the local bus system without using e.g. the control device of the textile machine or the main bus system, respectively.

Alternatively, the sensor and/or the drive motor and/or parameter adjustment assemblies and/or yarn control assemblies of the feeding device itself may be connected additionally to the local bus system.

In case of demand local bus systems of several yarn feeding devices may be interconnected at least selectively for a lateral communication. Then data may be transmitted from one local bus system into another local bus system, expediently under surveillance by the control device of a yarn feeding device which control device then is functioning as a master. It is possible to allow a direct intercommunication between accessory devices, e.g. for transmitting or recalling functional parameters which are valid for several equal accessory device within the yarn processing system. Basically, it may be expedient to separate the local bus systems from the rapid main bus system e.g. by the control device of the respective yarn feeding device.

In an alternative solution a selectively activated interface may be provided between the main bus system and at least one local bus system, e.g. in or at the control device of the respective yarn feeding device.

It is not necessary to base the local bus system on the UART-standard. Alternatively, the local bus system may be a CAN-bus system or a daisy chain bus system for serial data transmissions. In such cases, however, the high costs for each node in a local CAN-bus are only justified if accessory devices are connected which have extremely valuable equipment and functionality.

Each accessory device, expediently, is connected via at least one interface processor or a accessory PC board, respectively, to the yarn feeding device control device, or is connected to a yarn feeding device main PC board of the yarn feeding device control device. These designs simplify to exchange, remove or add accessory devices.

The node of a yarn feeding device in the main bus system expediently ought to comprise a cluster which connected to the main bus system via a general power supply.

Accessory devices connected to a local bus system of a yarn feeding device may be different natures. An accessory device at the entrance side of the yarn feeding device e.g. could be an electronic yarn run sensor and/or yarn breakage sensor, and/or yarn speed sensor, and/or yarn quality sensor which not only delivers signals into the local bus system but also may be adjusted in terms of its functional parameters. The accessory device receives the required information on the speed or the rotary angle e.g. via the SYNC-line incorporated into the local bus system. An accessory device at the entrance side of the yarn feeding device may be a yarn oiler or a yarn waxer treating the yarn with an impregnation agent such that the application of the impregnation agent is variable via the local bus system, that the function is monitored and in some cases information is exchanged on the filling level or the amount of the stored impregnating agent. Another accessory device at the entrance side could be a slip conveyor operating in dependence from the speed of the drive of the yarn feeding device and which needs to be adjusted to the speed. An accessory device at the exit side of the yarn feeding device may be a controlled yarn brake the braking effect of which needs to be varied, activated or de-activated during the yarns runs with the help of information transmitted in the local bus system. In this case also the speed or rotational angle information from the textile machine may be used in some cases by means of the SYNC-line. In the local bus system also a function monitoring or the like can be carried out. A further accessory device located at the exit side of the yarn feeding device may be a tensiometer for scanning or reporting the yarn tension. If needed, in such a case the tensiometer may be supplied with speed information via the SYNC-line, while measured values and functional parameters are transmitted in the local bus system. The measured values, e.g. may be used for controlling a yarn brake, e.g. by means of the local bus system. The operation or sensitivity of the tensiometer may be monitored or adjusted. The tensiometer may in some cases be integrated into or interlinked with a controlled yarn brake. A further accessory device at the exit side of the yarn feeding device is a weft yarn detector reporting in dependency from the speed or the rotational angle of the textile machine the yarn running motion or the yarn stop, and which emits in case of a disturbance a disturbance signal and which may be adjusted e.g. in terms of its sensitivity or may be calibrated, respectively, via the local bus system. An accessory device at the exit side of the yarn feeding device and in the local bus system even may be a variable slip conveyor. Furthermore, a pneumatic threading device or a pneumatic yarn removing device, which e.g. is activated or de-activated by means of solenoid valves and is surveyed in view to the operation, could be provided as an accessory device, or even a pneumatic yarn stretcher. Functional parameters for these accessory devices are transmitted in the local bus system, while the speed and rotation angle information is provide via at least one SYNC-line.

BRIEF DESCRIPTION OF THE DRAWINGS

Embodiments of the invention will be explained with the help of the drawings wherein.

DETAILED DESCRIPTION

Figure 1:
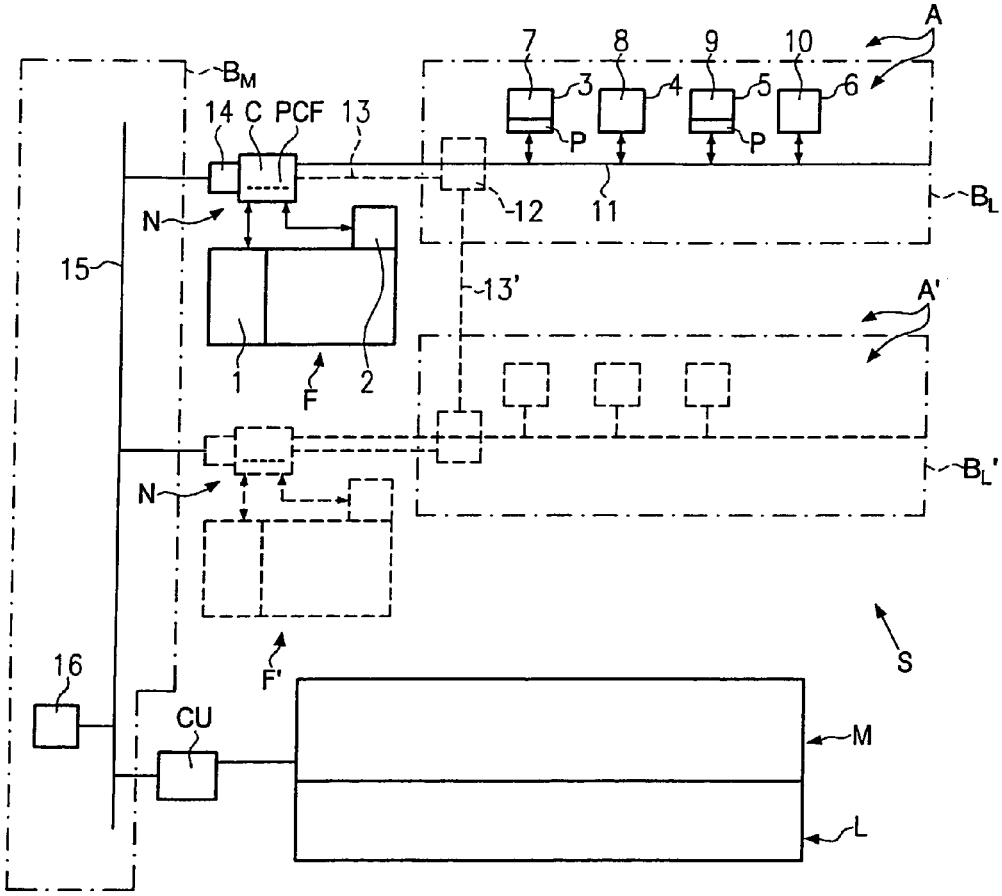
FIG. 1 is a schematic block diagram of a yarn processing system including at least one yarn feeding device and at least one local bus system for accessory devices.

A yarn processing system S shown in FIG. 1 includes at least one yarn feeding device F and a textile machine M, e.g. a weaving machine L, intermittently consuming the weft yarns fed by the yarn feeding device F. The weaving machine L may be a jet weaving machine, a rapier weaving machine, projectile weaving machine or even a jacquard weaving machine. Alternatively, the yarn processing system S could be a knitting machine having knitting yarn feeding devices. In addition to the yarn feeding devices shown in full lines further yarn feeding devices F' shown in dotted lines could be associated to the textile machine M.

The yarn feeding device F has an electronically controlled drive motor 1 and on-board sensors 2. The sensors 2 may, e.g., scan or control the size of a yarn store, yarn movements, the yarn withdrawal speed, and the like, or even may include a stopping device for measuring the weft yarn lengths for a jet weaving machine, respectively, which stopping device may be controlled in dependence from the weaving cycles. Furthermore, the yarn feeding device F is provided with a computerised electronic control device C, e.g. having a main PC-board PCF which may be integrated into the yarn feeding device F.

For controlling, treating, monitoring, scanning, etc. of the yarn peripheral accessory devices 3 to 6 are provided in the vicinity of the yarn feeding device F and along the yarn path. The accessory device 3 may be a yarn sensor or a yarn breakage sensor 7 monitoring the yarn movement or the yarn run at the entrance side of the yarn feeding device F while the drive motor 1 is running, or may be a yarn knot sensor or a yarn quality sensor. The accessory device 4 may be a yarn oiler or liquid dispenser or a yarn waxer 8 applying an impregnating agent to the yarn at the entrance side of the yarn feeding device, and having a drive. Those accessory devices 3, 4 need to be adjusted in terms of functional parameters and need to be informed e.g. additionally about the speed or the position of the drive motor 1 of the yarn feeding device F, in order to operate properly.

The accessory device 5 located at the exit side of the yarn feeding device F e.g. may be a controlled yarn brake or a pneumatic yarn stretcher 9 serving to adjust e.g. a predetermined yarn tension profile. The accessory device 6 at the exit side may be a tensiometer 10 or a weft yarn detector. The tensiometer measures the yarn tension and emits signals representing the yarn tension. The weft yarn detector emits messages e.g. whether or not the yarn moves at an expected point in time. The accessory devices 5 and 6 at least are adjustable in terms of their functional parameters. In some cases they will need information about the rotational angle or the position or the speed of the textile machine for a correct function.

Functional parameters which need to be adjusted for the yarn oiler or the liquid dispenser in dependence from the operation of the drive motor 1 e.g. are the driving speed in proportion to the speed of the drive 1 of the yarn feeding device and the activation and the de-activation. The functional parameters which are to be adjusted for a yarn breakage sensor at the entrance side are the activation and de-activation in dependence from the run of the drive motor 1, and, in some cases, an electronic filter effect or the response behaviour depending on the yarn speed or the speed of the drive motor 1, respectively. Similar functional parameters are to be adjusted for a yarn knot sensor or a yarn quality sensor. For a controlled yarn brake located at the exit side e.g. a yarn tension profile or a modulation scheme for the yarn tension are functional parameters which need to be adjusted. In case of a weft yarn detector at the exit side functional parameters, which need to be adjusted, may be the activation and de-activation in coincidence with the start and the end of an insertion cycle, as well as an electronic filter effect or the response behaviour and the activation duration, respectively, which, e.g., are correlated to the textile machine rotational angle. In case of a pneumatic yarn stretcher different pressure levels or activation and de-activation times may be functional parameters which need to be adjusted e.g. in correlation to the rotational angle of the textile machine. In case of a tensiometer the electronic filter effect or the response behaviour, respectively, and the transmission of the measuring results are functional parameters which need to be adjusted, e.g. in correlation to the rotational angle of the textile machine.

The information about the speed or the rotational angle or the position of the textile machine and/or of the drive of the yarn feeding device is not needed by each accessory device for a correct function. Simpler accessory devices may operate correctly without this information, provided that e.g. the functional parameters are adjusted and that the commands for activation or de-activation are transmitted.

In FIG. 1 the yarn feeding device F is provided with a local bus system BL for the accessory devices. The local bus system BL comprises e.g. a connection 11 with the control device C (including one or two conductors) including a logical ground, and is designed for a serial data transmission between the control device C and the accessory devices 3 to 6. Each accessory device 3 to 6 may be connected to the connection 11 via an interface processor or a PC-board P designed for a uni-directional or a bi-directional communication. The local bus system BL may be autonomic and includes in FIG. 1 e.g. accessory devices A which communicate with the control device C, i.e., emit signals representing a condition, or receive signals with the help of which they are starting or carrying out actions or with which their functional parameters are adjusted.

Each of the further yarn feeding devices F' also is equipped with a local, autonomic bus system BL' for accessory devices A' which may be the same or may differ from the accessory devices A in the local bus system BL of the yarn feeding device F.

In some cases in the connection 11 (a bus) of the local bus system BL an interface 12 may be provided which either directly or by means of a connection 13 from the control device C may be activated in order to selectively transmit or receive data to or from the local bus system BL' of a certain or of each yarn feeding device F' by means of a lateral connection 13'.

In FIG. 1 each yarn feeding device F', F' defines a node N in a rapid main bus system BM for a rapid serial communication (e.g. a CAN-bus system) to which the control devices C are connected via interface processors 14. The main bus system BM includes a connection 15 (a bus) which e.g. is connected to a superimposed control device 16 and/or a control device CU of the textile machine M.

In case that a main bus system BM is provided, each local bus system BL, BL' may be separated therefrom by means of the associated control device C. It also is possible to carry out a directed or processed data transmission from the local bus system into the main bus system or vice versa.

The local bus system BL, BL' may be a CAN-bus system or a daisy chain bus system, for a serial data transmission, respectively, or a serial, relatively simple and slow single conductor bus system using UART-connections conventionally present in the chip of the feeding device control device C for the bi-directional communication, particularly with the help of frame messages which are transferred in the form of byte-level-characters. In this case simple driving circuits suffice and low cost low-end microcontrollers in the accessory devices directly may be addressed. As a result, costly CAN nodes with costly CAN-controllers may be dispensed with. While in the main bus system in the case of a CAN bus system bit rates of more than 20 kbps are conventional, the bit rate in the local bus system instead would be less than 20 kbps in case of a single conductor bus system on the basis of two interlinked UART-connections. The local bus system BL serves mainly to transmit the above-mentioned functional parameters. In case of a CAN-local bus system, however, also the information about the speed or the rotational angle of the textile machine and/or of the yarn feeding device could be transmitted as well.

In FIG. 1 the drive motor 1 of the yarn feeding device F is controlled e.g. by using the signals of the sensor 2. In some cases the control or adjustment of the sensors 2 or of a stopping device of the yarn feeding device, respectively, is carried out independent from the data transmission in the local bus system BL.

Figure 2:
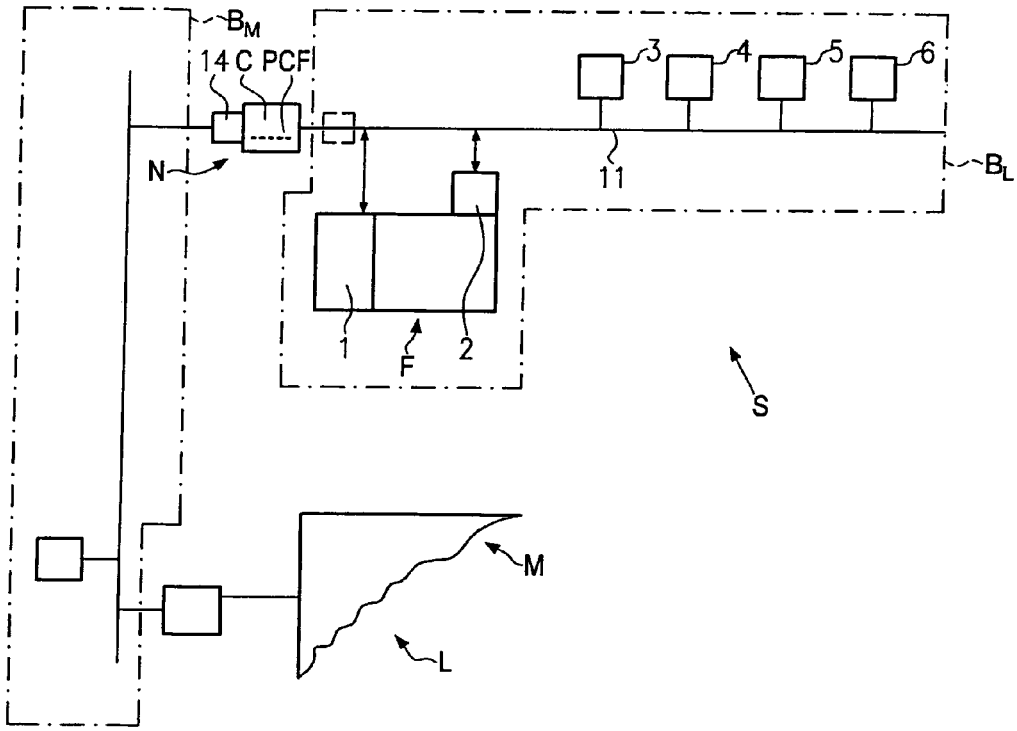
FIG. 2 is a schematic illustration of a further embodiment of a yarn processing system.

FIG. 2 indicates alternatively that also the control of the drive motor 1 and the data transmission to and from the sensor 2 of the yarn feeding device may take place in the local bus system BL of the yarn feeding device F. The control device C may be connected to the main bus system BM. Basically, if expedient, at least some control routines may be carried out at the yarn feeding device via the main bus system e.g. in association to the operation of the textile machine. However, each yarn feeding device F, F' could be operated even without the main bus system BM in another way but could, however, communicate within its local bus system BL with at least one accessory device. By means of the main bus system a communication is possible in some cases with each local bus system BL, particularly directly or indirectly. In such a case each local bus system would be designed as a simpler, slower and complementary subsystem of the main bus system.

Even though this is not shown in the figures also accessory devices in the region of a yarn supply (of the bobbin stand or the like) may be incorporated into at least one local bus system.

Figure 3:
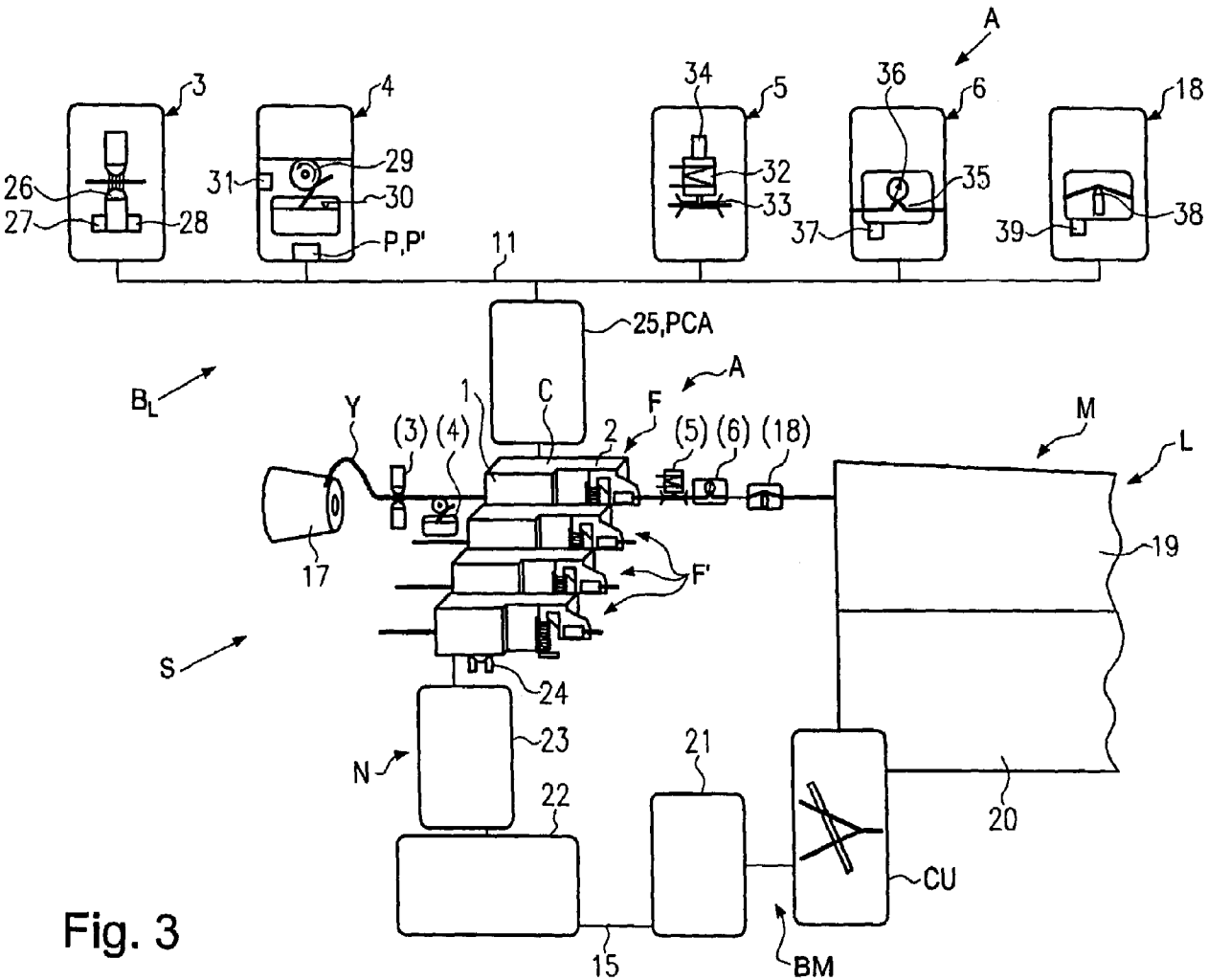
FIG. 3 is a detailed illustration of the yarn processing system of FIG. 1.

In the configuration of the yarn processing system S in FIG. 3 the textile machine M, e.g. a weaving machine L alternatingly consumes the yarn Y from some or from all of the yarn feeding devices F, F'. Each yarn feeding device withdraws the yarn Y from a supply bobbin 17, forms a intermediate store, and allows the insertion of the yarn depending on the demand by means of a not shown insertion device into a weaving shed 19 such that the insertion is monitored and is carried out with a certain yarn tension profile. The accessory devices A, A', 3 to 6, 18, are shown along the yarn path with their reference signs in brackets because they are illustrated in the highlighted local bus system BL in enlarged scale. This is true also for a weft yarn detector 18 in front of the weaving shed 19.

The weaving machine L has a drive system 20 which is connected to the control device CU and is controlled by the control device CU which permanently is provided (not shown) with information about the speed and/or the rotational angle and/or the position of the main shaft of the weaving machine L. The main bus system BM is connected to the control device CU, e.g. via a main bus system operation assembly 21. In the region of the node N the control device C of the yarn feeding device F is connected to the connection 15 (the main bus) e.g. via a so-called cluster 23 and a main power supply 22. The main bus or the connection 15 comprises at least two lines in a not shown fixation for the yarn feeding devices F, F'. At the fixation the yarn feeding devices are secured by means of clamping devices 24 such that the electrical connection to the main bus system BM is made by the installation. The local, autonomic bus system BL is connected to the control device C with its connection 11 e.g. via a local bus system-processor assembly 25 (or directly or via a not shown accessory device PC-board respectively).

The following accessory devices are connected to the connection 11 as a not limitative, exemplary selection of differing accessory devices A for the weft yarn feeding device of the weaving machine L:

The yarn sensor 3 contains an electronic sensor 26 which, e.g. depending on the speed or the position of the drive motor 1, scans the yarn motion or yarn stop or even the yarn speed, respectively, and supplies corresponding signals to the control device C. The yarn sensor 3, instead, could be designed as a quality sensor or a knot sensor or the like. In some cases the yarn sensor may comprise a function monitoring component 28 and an adjustment component 27 for the sensitivity and the response behaviour. The components 28, 27 emit monitoring signals and/or respond to transmitted signals and initiate an action.

The yarn oiler or yarn waxer 4 comprises a controlled drive 29 for applying the impregnating agent. The speed of the drive 29 and in some cases even the sense of rotation, the activation and de-activation, the acceleration or the like are controlled by signals from the control device C (e.g. in dependence from the speed of the drive motor 1), or by its own control device in another way. A reservoir may contain a filling level indication component 30. Furthermore, a function monitoring component 31 could be provided for transmitting disturbance information to the control device C.

A controlled yarn brake 5 e.g. contains a solenoid 32 as an electronically controlled drive for a displaceable braking element 33, and comprises, in some cases, a function monitoring component or an adjusting component 34 provided for communication with the control device C. The yarn brake operates in some cases depending on information about the rotational angle or the speed of the weaving machine L, respectively.

The tensiometer 6 comprises a signal generating electric component 35 apt to generate signals representing the yarn tension by means of an evaluation circuitry 36 and apt to transmit the signals to the control device C and/or even to the control device CU of the weaving machine L. Furthermore, a function monitoring/adjustment component 37 may be provided and integrated into the local bus system BL. The operation of the tensiometer 6 is carried out in some cases with the help of information about the rotational angle or the speed of the weaving machine L, respectively.

The yarn detector 8 or the weft yarn detector 18, respectively, monitors the yarn run, e.g. under consideration of information about the rotational angle or the position or the speed of the weaving machine L, and comprises an electronic sensor component 38 which generates corresponding signals. In some cases, additionally a calibrating or function monitoring component 39 may be provided, also serving for adjusting the electronic filter effect or the response behaviour, respectively. The yarn detector or weft yarn detector 18, 28 even may contain an evaluation circuitry for generating fault information as a signal while the yarn is scanned when the yarn runs or stops at a not expected point in time. Further, not shown accessory devices A may be integrated in the local bus system BL, e.g. a variable slip conveyor for the yarn and/or a pneumatic yarn stretcher and/or a pneumatic threading device of the yarn feeding device and/or a pneumatic yarn removing device.

The combination of the rapid main bus system BM with the sub-systems in the form of the local bus systems BL, BL' of the yarn feeding devices F, F' results in a universal and flexible communication system of high capacity wherein the data transmission in the respective local bus system for the accessory device is carried out in a customised fashion and without a collision with the data transmission in the main bus system. The yarn processing system, expediently, may operate with an operation voltage for the electronic of about 48 V but with a motor drive voltage of about 310 V. Within the main bus system also data may be transmitted to the yarn feeding devices which represent upcoming pattern developments in order to allow a preparatory operation behaviour of the yarn feeding devices without drastic decelerations or accelerations. Furthermore, e.g. the weft yarn length and the weaving machine speed may be transmitted. So-called trig signals or SYNC-signals (on the SYNC-line) may be transmitted from the weaving machine to each yarn feeding device. The yarn feeding devices accordingly process such signals. The signals provide information about the rotational angle, the speed, or the position of the weaving machine during the operation. These signals may also be supplied into the local bus systems. Each local bus system BL, BL' or the accessory devices are designed with customised intelligence and is, for those reasons, simpler and less costly than the main system since the local bus system does not have to take care of higher ranking or foreign control processes and monitoring processes.

In the figures only one local bus system is indicated for the accessory devices of a single yarn feeding device. It is, however, possible to associate several local and autonomic bus systems to each yarn feeding device which local bus systems respectively are provided for certain accessory devices or accessory device groups. In this case single point-to-point bus systems or bus systems extending from a master to several slaves are possible.

Figure 4:
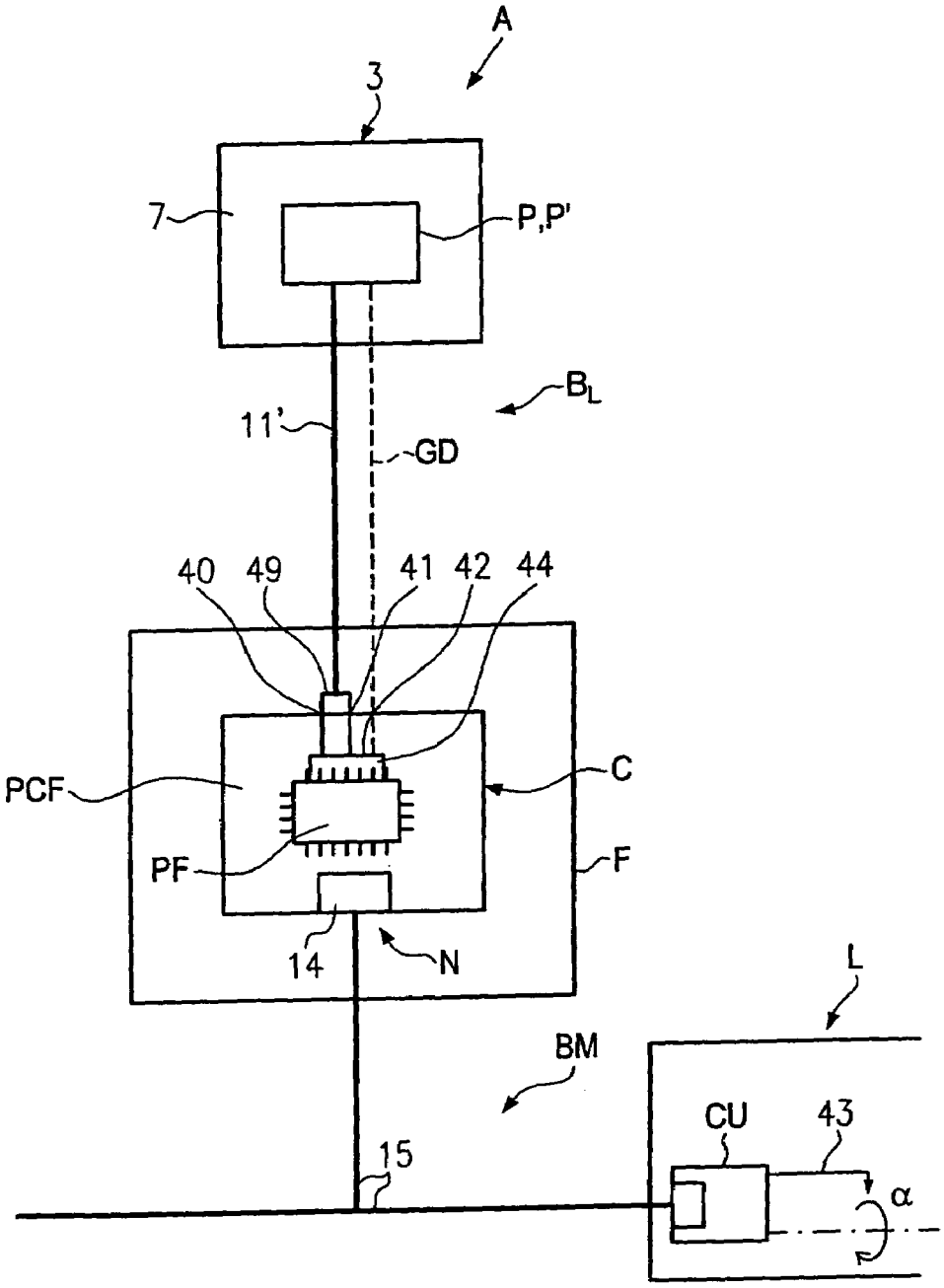
FIG. 4 is a simple embodiment of a yarn processing system having another design of a local bus system.

A particularly simple and low cost embodiment of a local bus system BL is shown in FIG. 4. The local bus system BL has a single conductor connection 11' (including the conventional logic earth (GD), based on the UART-connections 40, 41 (and 42 for the logic earth GD) which are conventionally provided at the chip or the processor of the control device C of the yarn feeding device F. The control device C e.g. contains a PC-board, PCF with at least one processor PF which is designed for a serial rapid communication with the bus 15 of the main bus system BM via the interface processor 14 in the node N. The control device CU of the weaving machine L also is incorporated into the main bus system BM. The control device CU receives information about the rotational angle $\alpha$ of a main shaft of the weaving machine L via a SYNC-line 34 (or information about the momentary speed and/or position of the weaving machine L, respectively).

The UART-connections 40, 41 e.g. provided at the exit of a driving circuit 44, are interconnected by a jumper 49 or the like at a location where the single conductor connection 11' extends to a simple microcontroller P' of the accessory device A, in this case e.g. the yarn sensor or the yarn breakage sensor 7 is connected. The driving circuit 44 forms e.g. with the single conductor connection 11' part of the local bus system BL for the accessory device A. Several accessory devices may be connected to the single conductor connection 11'. Mainly functional parameters, adjustment values and the like and return information is transmitted (bi-directionally) via the single conductor connection 11'. The logic earth GD is connected to the third UART-connection 42.

The desired serial communication either takes place only between the control device C and the accessory device 3, or, if needed, also with the main bus system BM with the help of the control device C.

Figure 5:
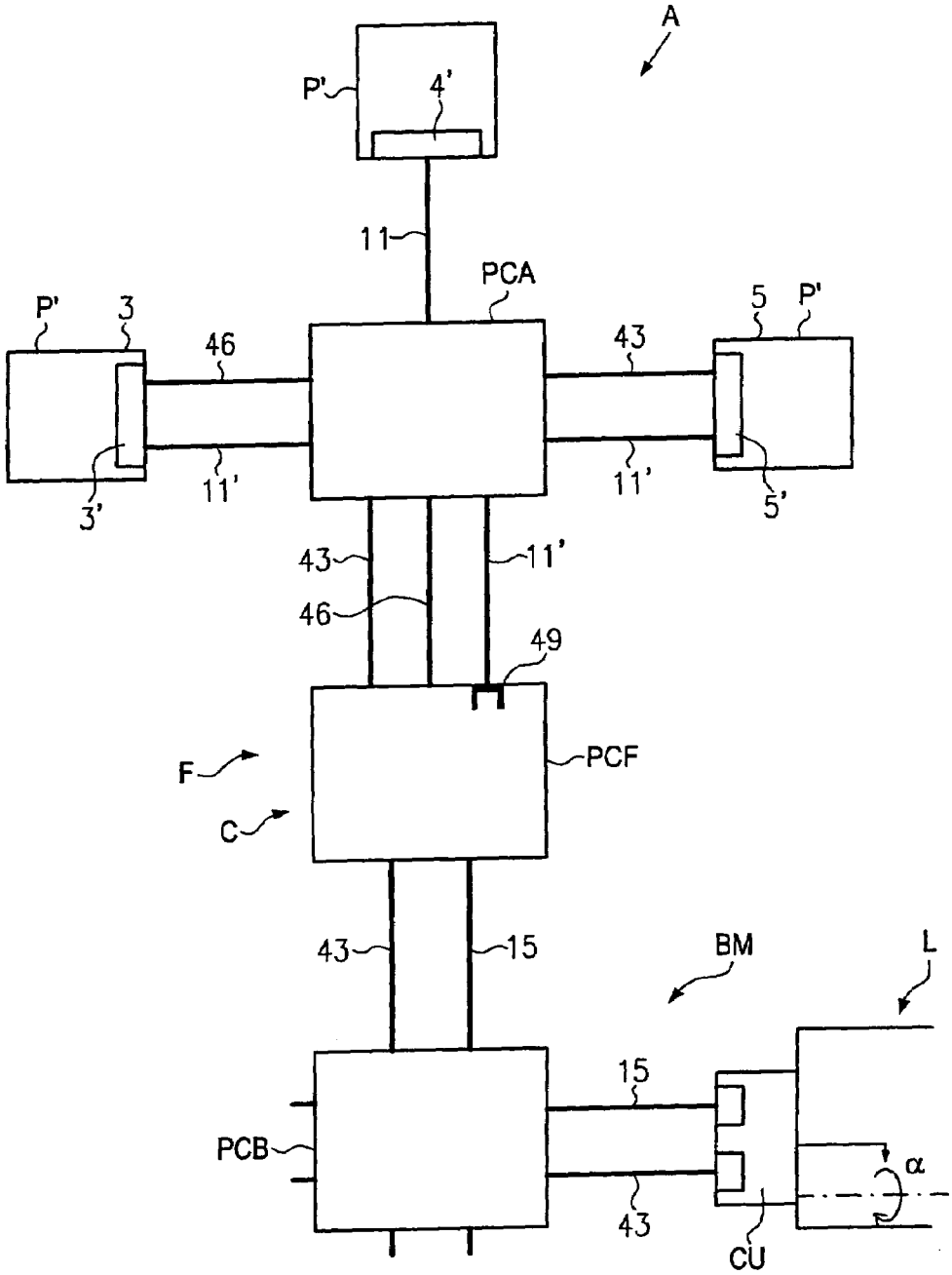
FIG. 5 is a more complex variant belong to FIG. 4.

FIG. 5 illustrates a simple and flexible communication system of a yarn processing system containing a rapid serial main bus system BM and a local slow serial bus system BL between which the control device C of the yarn feeding device F is provided. The main bus system BM e.g. is a CAN-bus system having the connection 15 extending from the control device CU of the weaving machine L via a control box PCB centrally provided for all yarn feeding devices to the main PC-board PCF of the control device C. In a separate SYNC-line 40 the rotational angle $\alpha$ or the speed or the position of the main shaft 44 of the weaving machine L is transmitted, e.g. in the form of a pulse chain proportionally to the speed. The SYNC-line 43 extends via the control box PCB to the main PC-board PCF of the yarn feeding device.

A PC-board PCA for all connected accessory devices 3, 5 is associated in the local bus system BL to the main PC-board PCF of the yarn feeding device F e.g. by means of a not shown connector. The signal conductor connection 11' extends from the jumper 49 to the board PCA, and in parallel thereto the SYNC-line 44, as well as a further SYNC-line 46 on which the rotational angle or the speed or the position of the drive motor 1 of the yarn feeding device is transmitted. The single conductor connection 11' continues from the board PCA to a microcontroller 3' of the accessory device 3, e.g. a yarn quality sensor, and to a microcontroller 5' of the accessory device 5, e.g. a controlled yarn brake. The separate SYNC-line 46 extends from the board PCA to the microcontroller 3', while the separate SYNC-line 43 extends to the microcontroller 5'.

Mainly functional parameters and other simpler messages are transmitted via the single conductor connection 11'. The accessory devices operate by using the information transmitted via the single conductor connection 11' and by using the information transmitted on the respective SYNC-line 43 or 46. The communication on the single conductor connection 11' is carried out serially with frames within which byte level characters are transferred, particularly in a half duplex bi-directional communication. The given UART specification allows to identify a simple "identifier" by which e.g. 60 basic messages can be defined. The byte transmission rate is smaller than 20 kbps. The local bus system BL constitutes a complementary sub-system of the rapid serial main bus system BM which, so to speak, defines the communication core within the yarn processing system. Since real-time information is provided for the accessory devices via the SYNC-lines 43, 46, the local bus system BL is made intelligent and flexible in view to adding or removing accessory devices.

Even not shown in FIG. 5, the single conductor connection 11' could extend from the main PC-board PCF of the yarn feeding device F to the control box PCB and from there to further accessory devices, in some cases even to accessory devices at the bobbin stand or bobbin creel. As a further alternative, the connection 15 of the main bus system BM could be continued into the board PCA, in order to, if desired, allow more sophisticated configuration of the local bus systems BL and, in some cases, to allow to connect further CAN-nodes.

Although a particular preferred embodiment of the invention has been disclosed in detail for illustrative purposes, it will be recognized that variations or modifications of the disclosed apparatus, including the rearrangement of parts, lie within the scope of the present invention.

The invention claimed is:

1. Yarn processing system, comprising:

at least one textile machine, particularly a weaving machine;

at least one yarn feeding device operatively associated with the textile machine;

at least one peripheral accessory device functionally associated with the yarn feeding device for controlling and/or treating and/or monitoring and/or scanning the yarn, said yarn feeding device and said accessory device defining a yarn path;

a computerized control device that is part of said yarn feeding device and which has a signal transmitting connection with the accessory device, the accessory device being provided with at least one electronic component for generating and/or receiving signals either presenting at least one condition or initiating at least one action;

a local bus system configured to serially communicate data between said yarn feeding device and said accessory device, said local bus system connecting to and being controlled by said control device that is part of said yarn feeding device so as to operate autonomously with respect to other yarn feeding devices, accessory devices, and local bus systems of other yarn paths; and a main bus system connected with at least one main control device of the textile machine or with a superimposed control device for serial rapid data communication, with the yarn feeding device and control device that is part of said yarn feeding device constituting at least one node of the main bus system, said node comprising at least one interface processor like a gateway processor;

wherein the local bus system operates at a first data transmission rate and the main bus system operates at a second data transmission rate, with the first data transmission rate being slower in comparison to the second data transmission rate.

2. Yarn feeding device, comprising:

a computerized control device;

several accessory devices for controlling and/or treating and/or monitoring and/or scanning the yarn along a yarn path, the accessory devices being functionally associated with the yarn feeding device, the respective accessory devices comprising electronic components being in signal transmitting connection with the computerized control device; and at least one local, autonomous bus system for serial data communication between the computerized control device and the accessory devices;

wherein the computerized control device of the yarn feeding device is incorporated into a rapid serial main bus system, and wherein the local bus system is a complementary, slower sub-system of the main bus system.

3. Yarn feeding device, comprising:

a computerized control device;

several accessory devices for controlling and/or treating and/or monitoring and/or scanning the yarn along a yarn path, the accessory devices being functionally associated with the yarn feeding device, the respective accessory devices comprising electronic components being in signal transmitting connection with the control device; and at least one local, autonomous bus system for serial data communication between the computerized control device and the accessory devices;

wherein the local bus system is completed by at least one separate SYNC-line for a real-time transmission of information representing the textile machine speed and/or the rotary angle and/or the position or the feeding device drive motor rotary angle and/or the speed of the drive motor and/or the drive motor position, and wherein the information is transmitted in the format of pulse chains which are proportional to the speed.

4. Yarn processing system as in claim 1, wherein the main bus system operates at a second data transmission rate of more than 20 kbps, while the local bus system operates at a first data transmission rate of less than 20 kbps, the local bus system being a local single conductor sub-system based on a UART-standard equipment of the control device of the yarn feeding device and being complementary to the main bus system.

5. Yarn processing system as in claim 4, wherein the local bus system is a single conductor connection of two combined UART-connections, the single conductor connection extending directly or via an accessory device PC-board to a microcontroller of the respective accessory device completed by at least one external driving circuitry, and wherein within the local bus system a bi-directional half duplex communication with defined messages in frame format can be carried out.

* * * * *